US007883359B2

(12) United States Patent
Osaki et al.

(10) Patent No.: US 7,883,359 B2
(45) Date of Patent: Feb. 8, 2011

(54) WATERPROOF CONNECTOR FOR FLEXIBLE SUBSTRATE

(75) Inventors: Takuya Osaki, Sakura (JP); Yuji Ishitani, Sakura (JP); Masahiro Kondo, Sakura (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 12/835,890

(22) Filed: Jul. 14, 2010

(65) Prior Publication Data

US 2010/0279541 A1 Nov. 4, 2010

Related U.S. Application Data

(63) Continuation of application No. PCT/JP2009/050468, filed on Jan. 15, 2009.

(30) Foreign Application Priority Data

Jan. 15, 2008 (JP) ..... 2008-005663
Dec. 2, 2008 (JP) ..... 2008-307445

(51) Int. Cl.
*H01R 12/24* (2006.01)

(52) U.S. Cl. ..... 439/492; 439/906; 439/731; 439/499

(58) Field of Classification Search ..... 439/492, 439/499, 731, 906
See application file for complete search history.

(56) References Cited

U.S. PATENT DOCUMENTS

| | | | | |
|---|---|---|---|---|
| 4,731,503 | A * | 3/1988 | Kitanishi | 439/492 |
| 6,434,316 | B1 | 8/2002 | Grois et al. | |
| 6,454,594 | B2 * | 9/2002 | Sawayanagi | 439/499 |
| 2005/0003701 | A1 * | 1/2005 | Sato et al. | 439/492 |
| 2007/0037436 | A1 | 2/2007 | Iwahori | |

FOREIGN PATENT DOCUMENTS

| | | | |
|---|---|---|---|
| JP | 10-189134 | A | 7/1998 |
| JP | 11-016628 | A | 1/1999 |
| JP | 2002-025651 | A | 1/2002 |

(Continued)

OTHER PUBLICATIONS

International Search Report of PCT/JP2009/050468, Mailing Date of Feb. 10, 2009.

*Primary Examiner*—Tho D Ta
(74) *Attorney, Agent, or Firm*—Westerman, Hattori, Daniels & Adrian, LLP

(57) ABSTRACT

A waterproof connector for a flexible substrate includes: a flexible substrate which includes an insulating film with a conductive pattern formed thereon; a connection terminal joined to the conductive pattern at a terminal section of the flexible substrate; a housing which accommodates the connection terminal; a retainer which includes a vertically assembled pair of members, a forward end thereof holding the connecting section of the conductive pattern and the connection terminal and a rear end thereof surrounding the flexible substrate; a hot-melt adhesive provided on an inner circumference of the retainer at non-joint areas with the flexible substrate and provided on an outer circumference of the retainer so as to make the flexible substrate and the retainer adhere closely to each other; engaging member provided in the outer circumference of the retainer; and receiving member provided in the housing. The engaging member and the receiving member are engaged together to fix the retainer and the housing.

6 Claims, 10 Drawing Sheets

FOREIGN PATENT DOCUMENTS

| | | | |
|---|---|---|---|
| JP | 2002-170627 | A | 6/2002 |
| JP | 2002-298956 | A | 10/2002 |
| JP | 2004-139138 | A | 5/2004 |
| JP | 2004-220864 | A | 8/2004 |
| JP | 2007-042449 | A | 2/2007 |

* cited by examiner

WATERPROOF CONNECTOR FOR FLEXIBLE SUBSTRATE

BACKGROUND OF THE INVENTION

1. Field of the Invention

The present invention relates to a waterproof connector for the electrical connection of a flexible substrate, and more particularly to a waterproof connector for a flexible substrate that provides a waterproof connection.

Priority is claimed on Japanese Patent Application No. 2008-005663, filed Jan. 15, 2008, and Japanese Patent Application No. 2008-307445, filed Dec. 2, 2008, the contents of which are incorporated herein by reference.

2. Description of the Related Art

Conventionally, application of flexible substrates to vehicles has been increasing. In such application, it is required to connect a flexible substrate to a conductor wire at a single terminal. In the application to the vehicles, it is especially important to protect the connecting section by imparting waterproofness so as to keep a highly-reliable connection. There is therefore a demand for a waterproof connector for a flexible substrate that includes an electrical terminal for interconnection between the flexible substrate and a conductor wire accommodated in an easily assembled case housing so as to provide effective waterproofing.

An exemplary waterproof connector for a flexible substrate of the related art includes a flexible substrate 110, a connection terminal 120 and a housing 130 as shown in FIG. 15. The flexible substrate 110 includes an insulating film 111 on which a conductive pattern 112 is formed. The connection terminal 120, made of a metal material, includes a plate-like joint terminal that is connected to the conductive pattern 112 at a terminal section of the flexible substrate 110. The housing 130 accommodates the connecting terminal 120. In the related art waterproof connector 100, the conductive pattern 112 at the terminal section of the flexible substrate 110 and the joint terminal of the connection terminal 120 are joined by, for example, resistance welding (e.g., series welding) to form a connecting section. The connecting section is sealed with a first resin mold 125. The connecting section is accommodated in a connecting section receiving hole 131 formed in the housing 130 at a base end along a direction into which the connector is fit. The base end of the housing 130 is sealed with a second resin mold 126.

The waterproof connector 100 is obtained in the following manner. A connecting section of the flexible substrate 110 with a connection terminal 120 formed thereon is sealed with the first resin mold 125 consisting, for example, of polyamide hot-melt resin. The connecting section is accommodated in the connecting section receiving hole 131 of the housing 130. Then, the base end of the housing 130 is sealed with the second resin mold 126 consisting of the hot-melt resin similar to that of the first resin mold 125. The waterproof connector 100 can therefore be manufactured collectively in single equipment (e.g., a hot-melt adhesive filling device) while preventing an increase in the processing cost and thus an increase in the manufacturing cost. It is not necessary to provide a wire seal or other material at the terminal of the flexible substrate so as to impart waterproofness. Accordingly, the material costs may also be decreased (see Japanese Unexamined Patent Application, First Publication No. 2002-170627).

In the waterproof connector 100 disclosed in Japanese Unexamined Patent Application, First Publication No. 2002-170627, the connection terminal 120 may be connected with the flexible substrate 110 due to a spring effect of the connecting terminal 120. In this case, if the connecting section is sealed by the hot-melt adhesive, the spring force is eliminated and thus the connection becomes unstable. In addition, the hot-melt adhesive (i.e., the second resin mold 126) is exposed from the housing 130. As a result, an external force acts on the hot-melt adhesive (i.e., the second resin mold 126) during handling of the connector 100. As a result, the hot-melt adhesive may be chipped or otherwise damaged, or adhesion strength between the hot-melt adhesive and the housing 130 may decrease, thereby causing deterioration in the fixing force and waterproofness.

SUMMARY OF THE INVENTION

An object of the invention is to provide a waterproof connector for a flexible substrate that provides a waterproof connection while keeping a spring effect of a connection terminal.

The invention employs the followings in order to achieve the above-described object and to solve the problems of the related art.

(1) A waterproof connector for a flexible substrate includes: a flexible substrate which includes an insulating film with a conductive pattern formed thereon; a connection terminal joined to the conductive pattern at a terminal section of the flexible substrate; a housing which accommodates the connection terminal; a retainer which includes a vertically assembled pair of members, a forward end thereof holding the connecting section of the conductive pattern and the connection terminal and a rear end thereof surrounding the flexible substrate; a hot-melt adhesive provided on an inner circumference of the retainer at non-joint areas with the flexible substrate and provided on an outer circumference of the retainer so as to make the flexible substrate and the retainer adhere closely to each other; engaging member provided in the outer circumference of the retainer; and receiving member provided in the housing. The engaging member and the receiving member are engaged together to fix the retainer and the housing.

(2) Preferably, a plurality of small projections is provided on opposing surfaces at a rear end of the retainer.

(3) Preferably, the connecting section has a spring effect; and the forward end of the retainer holds the connecting section so as not to impair the spring effect of the connecting section.

(4) Preferably, the hot-melt adhesive is provided to surround the flexible substrate that is disposed within the rear end of the retainer without escaping from the rear end of the retainer.

(5) Preferably, the water proof connector further includes a sealing member that surrounds an outer circumference of the hot-melt adhesive provided on the outer circumference of the retainer.

(6) Preferably, the connection terminal is a female terminal; the housing is a female housing; and the waterproof connector further includes a male housing that receives the female housing.

According to the waterproof connector (1), the joint section of the terminal section of the flexible substrate and the connection terminal can be firmly sealed with the hot-melt adhesive while keeping a spring effect of the connection terminal. In addition, the external force acting on the hot-melt adhesive is reduced so as to prevent deterioration in adherence and waterproofness.

DESCRIPTION OF REFERENCE NUMERALS

Figure 1:
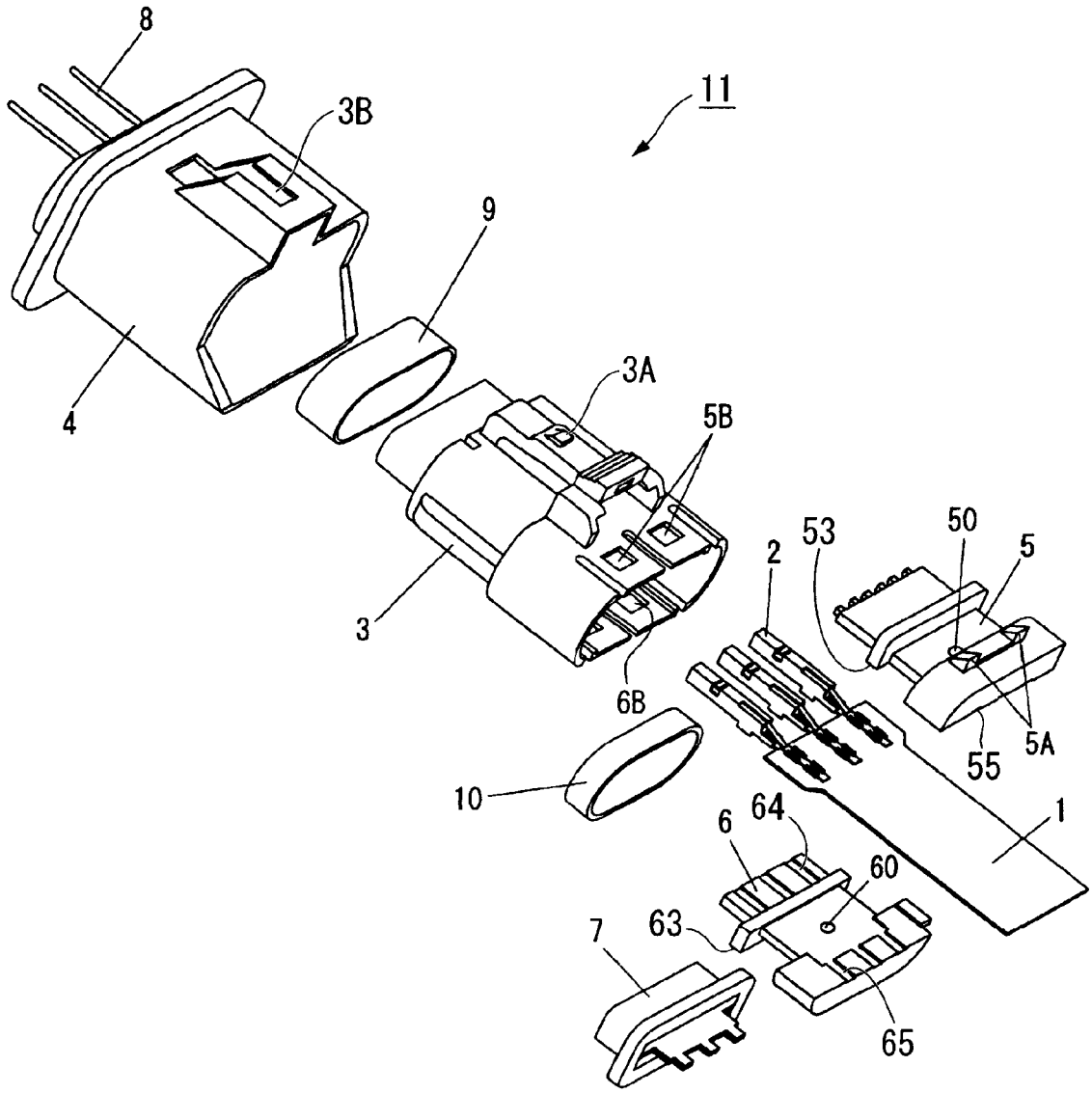
FIG. 1 is an exploded perspective view of a waterproof connector for a flexible substrate according to a first embodiment of the invention.

1: flexible substrate
2: connection terminal (female terminal)
3: housing (female housing)
4: male housing
5: first member
6: second member
7: hot-melt adhesive
10: sealing member
11, 12: waterproof connector for a flexible substrate

DESCRIPTION OF THE PREFERRED EMBODIMENTS

Referring now to the drawings, the preferred embodiments of the invention will be described.

First Embodiment

FIG. 1 is an exploded perspective view schematically showing a waterproof connector 11 for a flexible substrate according to a first embodiment of the invention. The connector 11 of the present embodiment includes a flexible substrate 1, a connection terminal (i.e., a female terminal) 2 and a housing (i.e., female housing) 3. The flexible substrate 1 includes an insulating film with an unillustrated conductive pattern formed thereon. The female terminal 2 is electrically joined to the conductive pattern at a terminal section of the flexible substrate 1. The female housing 3 accommodates the female terminal 2. The female housing 3 is fit into a male housing 4. The connection terminal 2 is electrically connected to a male terminal 8 formed in the male housing 4.

A connecting section $\alpha$ of the conductive pattern of the flexible substrate 1 and the connection terminal 2 is held between a forward end of a retainer, which includes a vertically assembled pair of a first member 5 and a second member 6. A rear end of the retainer surrounds the flexible substrate 1. In particular, the retainer, includes the first member 5 and second member 6 aligned with each other, includes a space for receiving a connecting section $\alpha$ at which the flexible substrate 1 and the connection terminal 2 are joined together. The space is defined by a first recess 54 formed in the first member 5 and a second recess 64 formed in the second member 6. A liquid hot-melt adhesive is injected into the retainer from a hole 50 formed in the first member 5 and a hole 60 formed in the second member 6. The first member 5 and the second member 6 include stepped portions 53 and 63 for preventing ingression of the hot-melt adhesive 7 into the space. The flexible substrate 1 is held directly by the first member 5 and the second member 6 closely behind the space (i.e., at the stepped portions 53 and 63).

The first member 5 and second member 6 include the holes 50 and 60 behind the stepped portions 53 and 63 through which the hot-melt adhesive 7 is injected. The hot-melt adhesive 7 is injected between the retainer and the flexible substrate 1 through the holes 50 and 60. Non-joint areas 55 and 65 at the rear end of the retainer (i.e., the first member 5 and second member 6) around the flexible substrate 1 are also filled with the hot-melt adhesive 7. The hot-melt adhesive 7 never escapes from the inner circumference of the retainer (i.e., the first member 5 and second member 6).

Figure 4:
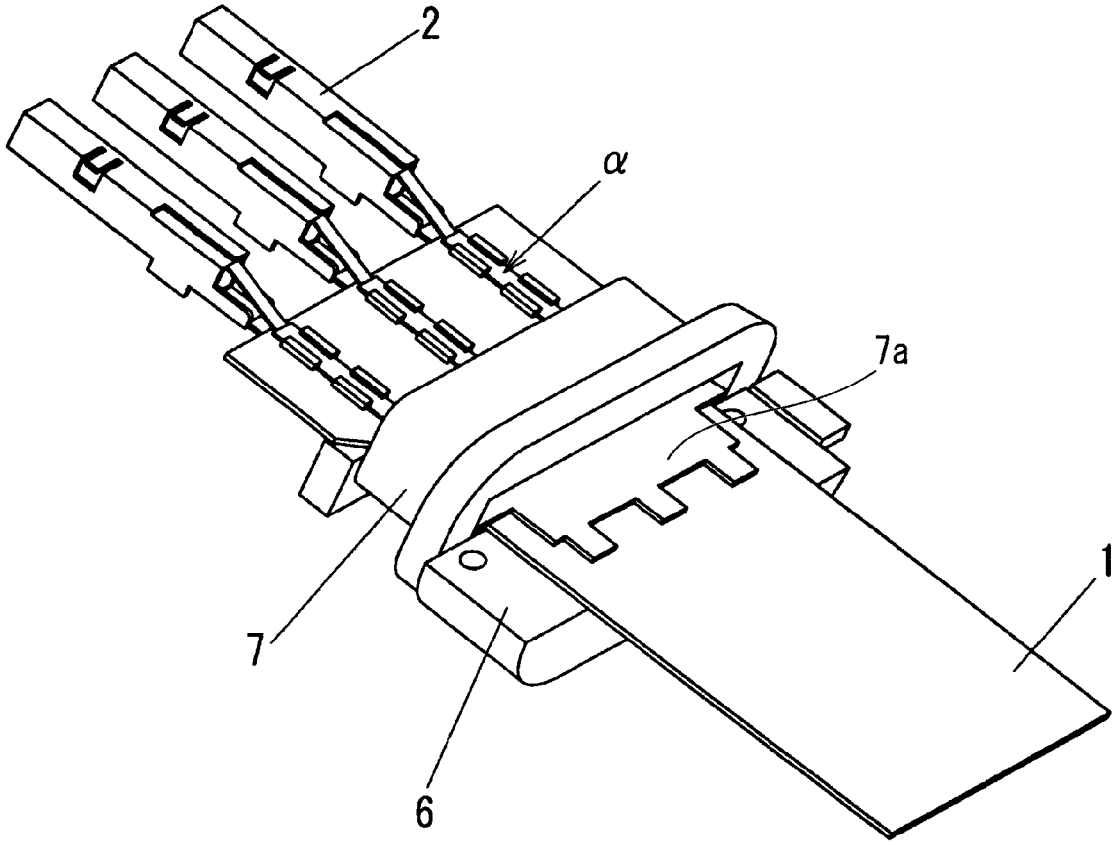
FIG. 4 is a perspective view of the flexible substrate and the female terminal according to the first embodiment before an upper retainer is assembled thereto.

FIG. 4 is a perspective view of the hot-melt adhesive 7 filled in an outer circumference and an inner circumference (i.e., the internal space) of the retainer (i.e., the first member 5 and second member 6). As shown in FIG. 4, the hot-melt adhesive 7*a* injected into the non-joint areas 55 and 65 and cured on the inner circumference of the retainer (i.e., the first member 5 and second member 6) prevents water ingression from an insertion opening (i.e., the rear end of the retainer) of the flexible substrate 1 into the connection terminal 2.

Figure 5:
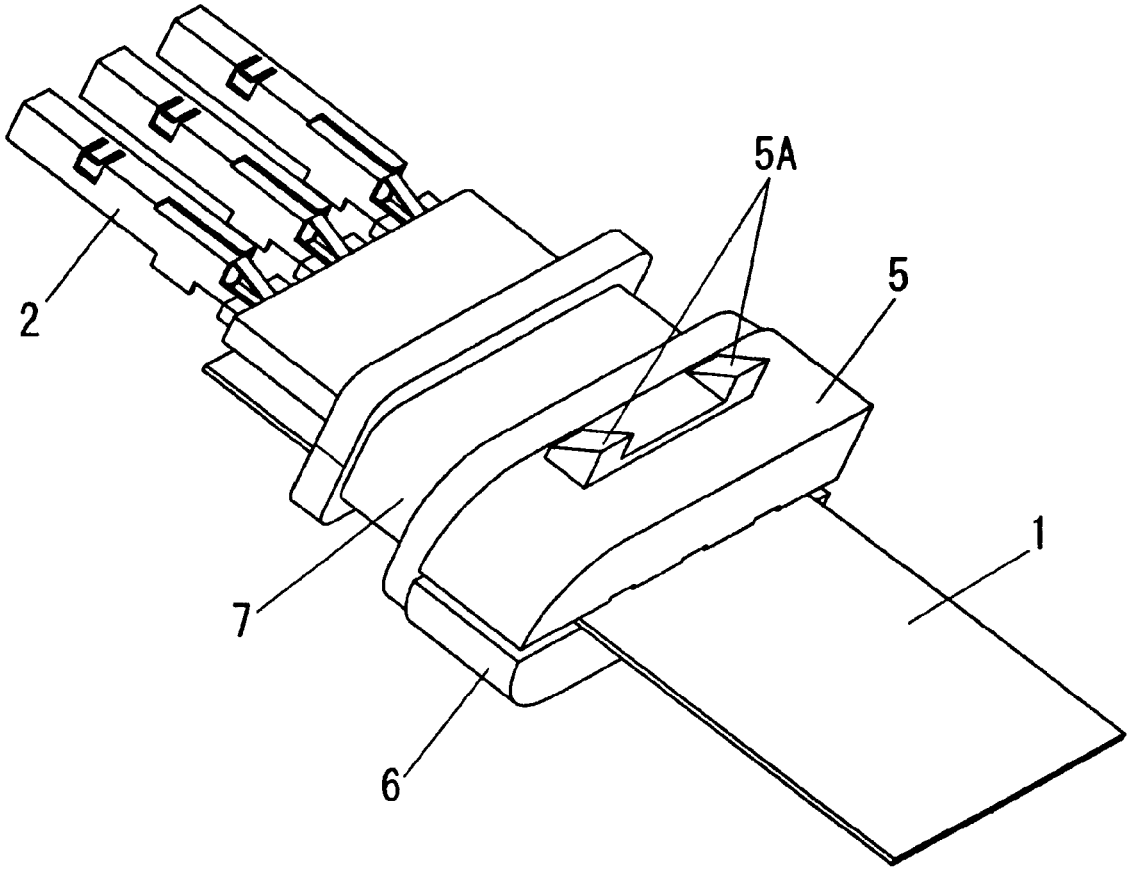
FIG. 5 is a perspective view of the first embodiment with an upper retainer assembled thereto.

As shown in FIG. 5, the hot-melt adhesive 7 is provided to cover at least a part of the outer circumference of the retainer so as to fix the first member 5 and the second member 6 together. In this manner, the flexible substrate 1 and the retainer are made to adhere closely to each other. The first member 5 and the second member 6 are integrated together to function as a single retainer.

The first member 5 and second member 6 may alternatively be connected together at one longitudinal direction end thereof with a hinge as will be described in a second embodiment.

The male housing 4 includes a male terminal 8 which is fit into and connected electrically with the connection terminal (i.e., the female terminal) 2.

A housing seal 9 is provided at a forward end of the female housing 3 to seal a fitting portion of the housings 3 and 4. The housing seal 9 may be an O-ring, sealing resin or oil.

Figure 6:
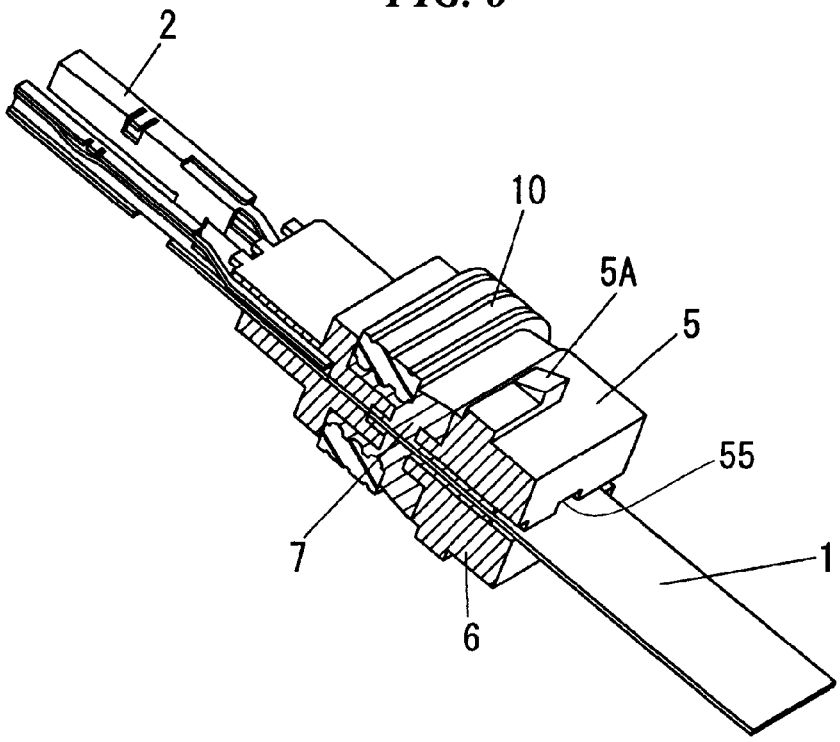
FIG. 6 is a perspective view of a cross section of FIG. 5.
Figure 7:
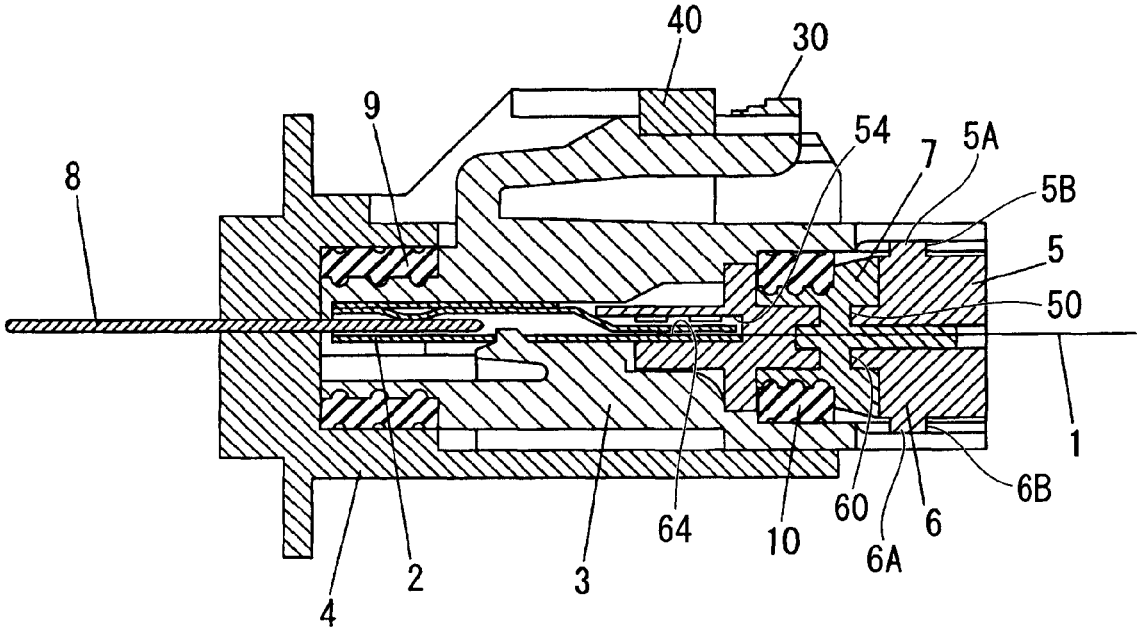
FIG. 7 is a cross-sectional view of the first embodiment with a female housing fit into a male housing.

As shown in FIGS. 6 and 7, a sealing member 10 is provided on an outer circumference of the hot-melt adhesive 7. The sealing member 10 seals between the female housing 3 and the outer circumference of the hot-melt adhesive 7 and consequently seals the flexible substrate 1. The sealing member 10 may be rubber packing, an O-ring, sealing resin or oil.

The sealing member 10 includes a groove on a surface to be in contact with the female housing 3. Such a configuration improves the adhesion strength between the sealing member 10 and the female housing 3. A ring-shaped projection is formed on the surface of the sealing member 10 to be in contact with the hot-melt adhesive 7. Such a configuration prevents slippage between the sealing member 10 and the hot-melt adhesive 7 and therefore improves the adhesion strength. In this manner, water ingression at the interface of the sealing member 10 and the female housing 3 and at the interface of the sealing member 10 and the hot-melt adhesive 7 is prevented.

Figure 2:
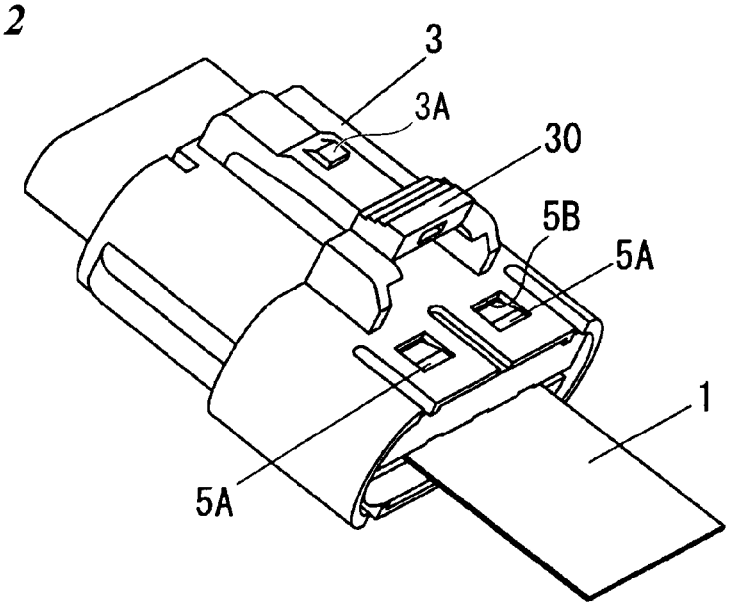
FIG. 2 is a perspective view of the flexible substrate and a female terminal accommodated in a female housing according to the first embodiment.

FIG. 2 is a perspective view of a state in which the flexible substrate 1 is received in the female housing 3. The retainer (i.e., the first member 5 and second member 6) includes engaging members (i.e., pawls 5A and 6A) formed in the outer circumferences thereof. The housing (i.e., the female housing) 3 includes receiving members (i.e., engaging holes 5B and 6B). The engaging members (i.e., the pawls 5A and 6A) engage the receiving members (i.e., the engaging holes 5B and 6B) so that the retainer (i.e., the first member 5 and second member 6) and the housing 3 are fixed together.

Figure 3:
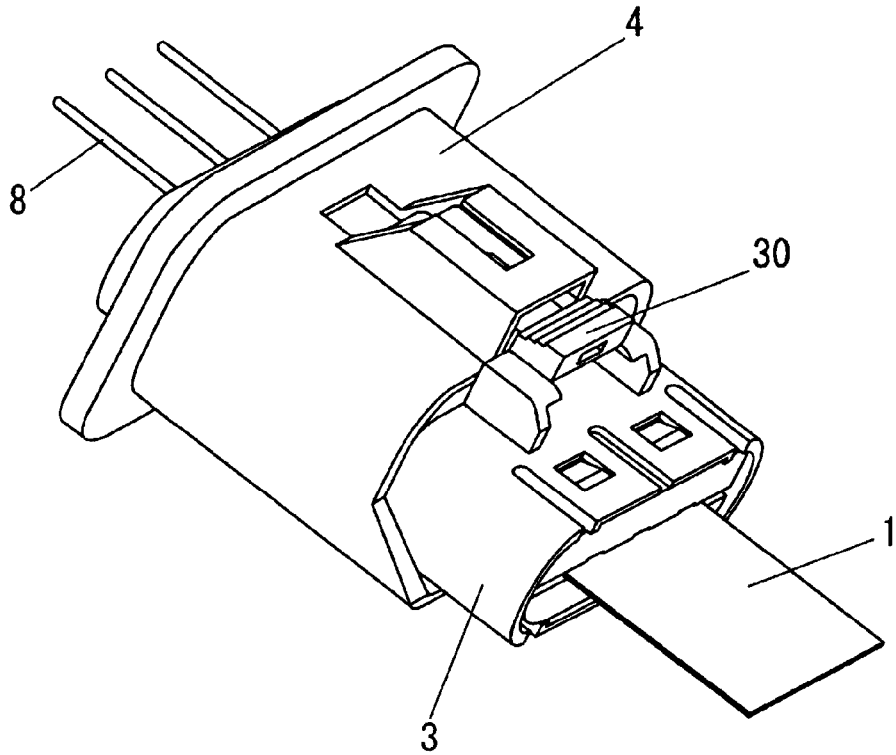
FIG. 3 is a perspective view of a state in which the female housing shown in FIG. 2 is fit into a male housing.

FIG. 3 is a perspective view of a state in which the female housing 3 is fit into the male housing 4. A spring piece 30 is provided in an outer circumference of the female housing 3. An engaging portion 40 is formed in the male housing 4. The spring piece 30 engages the engaging portion 40 so as to fix the female housing 3 and the male housing 4 together.

FIG. 7 is a cross-sectional view through the holes 50 and 60 in a state in which the female housing 3 fits into the male housing 4. Each pawl 5A and 6A of the retainer (i.e., the first member 5 and second member 6) engage the engaging holes 5B and 6B (see FIG. 1) of the female housing 3. The spring piece 30 formed in the female housing 3 engages the engaging portion 40 of the male housing 4.

The flexible substrate 1 is made to adhere to the retainer (i.e., the first member 5 and second member 6) via the hot-melt adhesive 7. The pawls 5A and 6A engage the engaging holes 5B and 6B of the female housing 3. The hot-melt adhesive 7 is thus not provided outside the female housing 3. With this configuration, when the force to draw the flexible substrate 1 to the right in FIG. 7 (i.e., load occurring during handling of the connector) acts on the connector, no load will be applied directly to the connecting section α.

The hot-melt adhesive 7 is provided to surround the flexible substrate 1. Thus, the adhesion area of the flexible substrate 1 and the hot-melt adhesive 7 is increased to improve the adhesive strength.

The spring effect of the female terminal 2 between the connecting section α and the flexible substrate 1 is not reduced because the connecting section α is not fixed by the hot-melt adhesive 7.

The waterproof connector 11 for a flexible substrate of the present embodiment has three possible ingression paths of water: the interface of the flexible substrate 1 and the hot-melt adhesive 7 (i.e., a first water ingression path); the interface of the sealing member 10 and the hot-melt adhesive 7 (i.e., a second water ingression path); and the interface of the housing seal 9 and the female housing 3 (i.e., a third water ingression path). The first water ingression path is blocked by the hot-melt adhesive 7 adhering to the flexible substrate 1. The second water ingression path is blocked by the compressed sealing member 10. The third water ingression path is blocked by the compressed housing seal 9.

Figure 8:
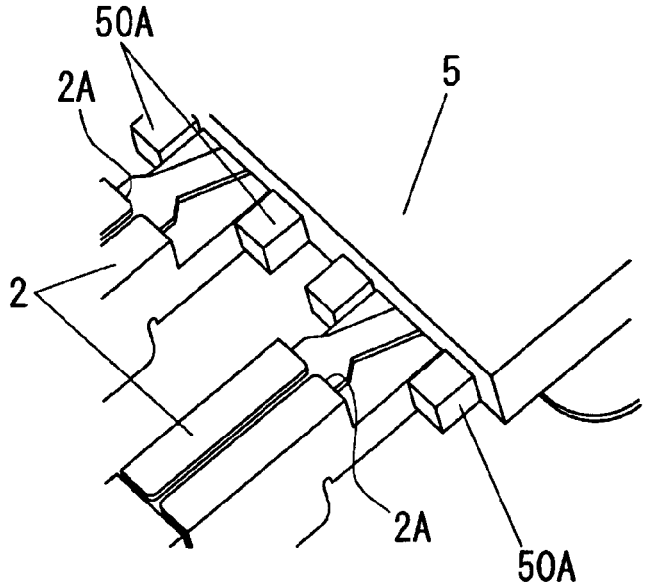
FIG. 8 is a partially enlarged perspective view of the female terminal and a retainer according to the first embodiment.
Figure 9:
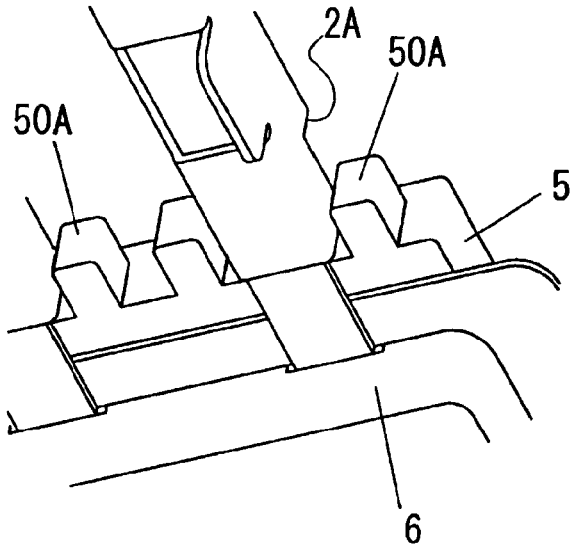
FIG. 9 is a perspective view of FIG. 8 seen from below.

FIGS. 8 and 9 are partially enlarged perspective views showing a relationship between the female terminal 2 and the retainer (i.e., the first member 5 and second member 6). Unlike the related art, the connecting section α of the female terminal 2 and the flexible substrate 1 in the present embodiment are not fixed by the hot-melt adhesive 7. To help the insertion of the female terminal 2 in the female e housing 3, a terminal support projection 50A is formed in the first member 5. Both folded end surfaces 2A of the female terminal 2 are made to depress end walls defined between adjacent terminal support projections 50A of the first member 5. The terminal support projection 50A prevents left or right leaning of the female terminal 2.

Figure 10:
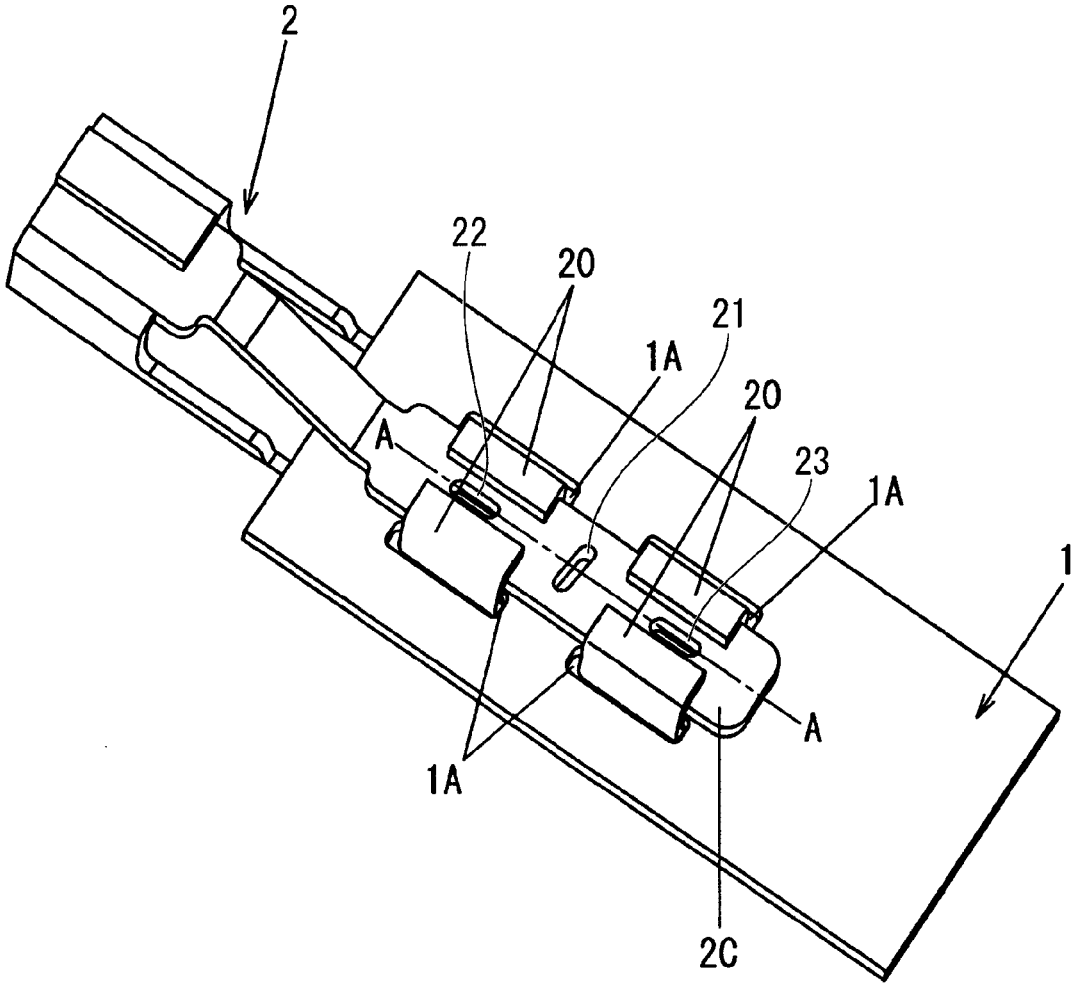
FIG. 10 is an enlarged perspective view of a female terminal connecting section according to the first embodiment.
Figure 11:
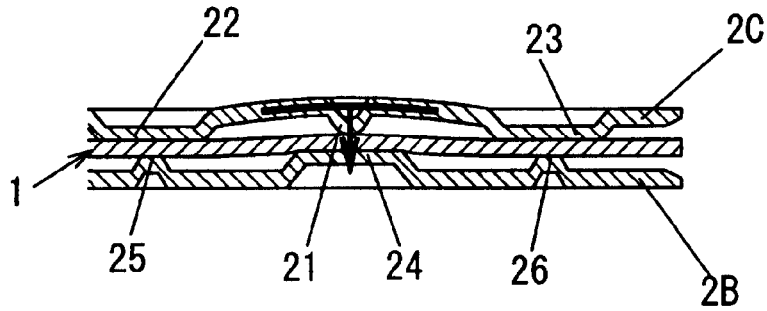
FIG. 11 is a cross-sectional view taken along line A-A in FIG. 10.

An exemplary connecting structure of the flexible substrate 1 and the female terminal 2 is shown in FIGS. 10 and 11. In this example, the female terminal 2 includes upper plate 2C and lower plate 2B at the forward end thereof. A barrel 20 formed in the lower plate 2B is inserted in a hole 1A formed in the flexible substrate 1. The barrel 20 is folded inward to clutch the upper plate 2C such that the upper plate 2C is drawn toward the lower plate 2B. In this manner, the female terminal 2 is assembled to the flexible substrate 1. The flexible substrate 1 is held between the upper plate 2C and the lower plate 2B as shown in FIG. 11. FIG. 11 is a cross-sectional view taken along line A-A in FIG. 10.

A projection 21 elongated along the width of the upper plate 2C is provided in a middle portion of the upper plate 2C. Projections 22 and 23 elongated along the length of the upper plate 2C are provided in the upper plate 2C at adjacent opposite sides of the projection 21. These projections 21 to 23 press the flexible substrate 1 against the lower plate 2B.

Projections 24 to 26 corresponding to the projections 21 to 23 are provided in the lower plate 2B. The projection 24 elongated along the length of the lower plate 2B is provided in the middle portion of the lower plate 2B as in the upper plate 2C. The projections 25 and 26 elongated along the width of the lower plate 2B are provided adjacent to the projection 24 in the lower plate 2B. The height of the projection 24 is greater than those of the projections 25 and 26. Accordingly, the projection 21 of the upper plate 2C presses the flexible substrate 1 due to the spring effect. In this manner, the flexible substrate 1 is deformed in a waveform by the projections 21 and 24, and the flexible substrate 1 is securely held therebetween.

Second Embodiment

Figure 12:
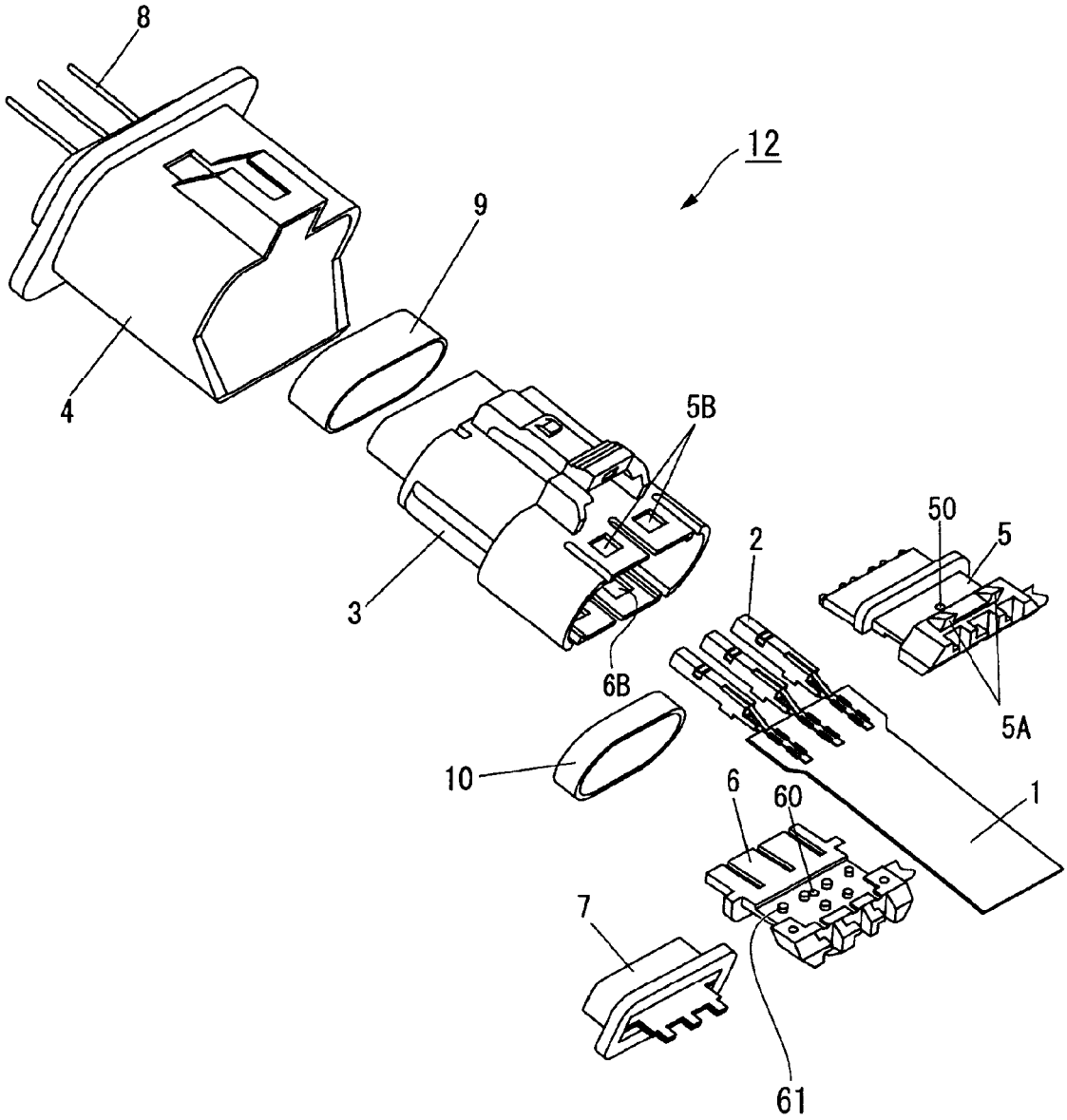
FIG. 12 is an exploded perspective view of a waterproof connector for a flexible substrate according to a second embodiment of the invention.

FIG. 12 is an exploded perspective view schematically showing a waterproof connector 12 for a flexible substrate according to a second embodiment of the invention. The waterproof connector 12 for a flexible substrate differs from the waterproof connector 11 for a flexible substrate of the first embodiment in that a plurality of small projections 51 and 61 are provided on opposing surfaces 5*a* and 6*a* at a rear end of a retainer. In the present embodiment, the retainer constitutes a first member 5 and a second member 6 which are connected together at one longitudinal direction end thereof with a hinge 56.

Figure 13:
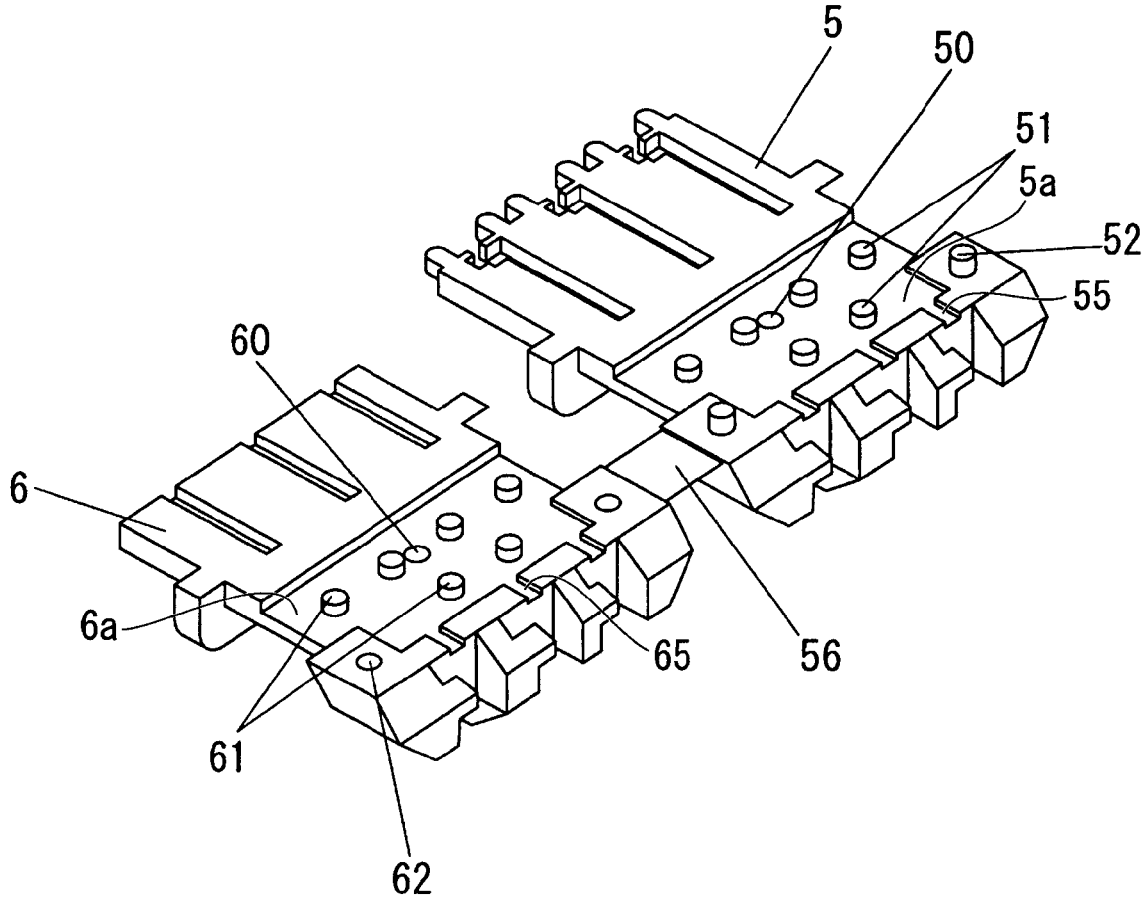
FIG. 13 is a developed perspective view of a retainer according to the second embodiment.

FIG. 13 is a perspective view of the retainer (i.e., the first member 5 and second member 6) in its open state before the hinge 56 is folded. Six small projections 51 and 61 are provided on the opposing surfaces 5*a* and 6*a* at the rear end of a retainer (i.e., the first member 5 and second member 6) as shown in FIG. 13. The retainer (i.e., the first member 5 and second member 6) includes a row of four small projections, with two small projections disposed at one side of the holes 50 and 60 through which the hot-melt adhesive 7 is injected and another two small projections disposed at the other side of the holes 50 and 60. The retainer also includes a row of two small projections disposed adjacent to those two small projections nearest to the holes 50 and 60. The small projections 51 provided to the first member 5 and the small projections 61 provided to the second member 6 are opposing one another. The small projections 51 and 61 hold the flexible substrate 1 from both sides.

The flexible substrate 1 may be deformed during injection of the hot-melt adhesive 7 from the holes 50 and 60. The flexible substrate 1 may also be deformed if the hot-melt adhesive 7 is cooled and cured at different rates on the sides of the first member 5 and the second member 6. Since the flexible substrate is held from both sides by the small projections 51 and 61, these small projections 51 and 61 keep the flexible substrate horizontal during injection of the hot-melt adhesive 7 or even if the hot-melt adhesive 7 is cooled and cured at different rates on the sides of the first member 5 and the second member 6.

In the event of rapid temperature changes, the adhesion interface of the hot-melt adhesive 7 and the retainer may become out of alignment due to their inherent linear coefficients of expansion. In the present embodiment, however, the plurality of small projections 51 and 61 prevent misalignment in the adhesion interface. Accordingly, adhesion strength between the hot-melt adhesive 7 and the retainers (i.e., the first member 5 and second member 6) is retained.

As described above, the waterproof effect is further increased in the waterproof connector for a flexible substrate of the present embodiment as compared to the first embodiment.

In the retainer of the present embodiment, the first member 5 and the second member 6 are connected together at one longitudinal direction end thereof with the hinge 56. The first member 5 includes two engaging projections 52 that engage two engaging holes 62 provided in the second member 6. When the hinge 56 is folded so as to align the first member 5 and second member 6 together, the engaging projections 52 on the first member 5 engage the engaging holes 62 on the second member 6. In this manner, the retainer is kept with the first member 5 and second member 6 aligned together. The thus-obtained retainer hardly becomes out of alignment.

The flexible substrate 1 closely adheres to the first member 5 and second member 6 between the engaging projections 52 so that the flexible substrate 1 is disposed between the engaging projections 52. The space in which the small projections 51 and 61 of the first member 5 and second member 6 are provided defines closed rooms (i.e., rooms considered to be closed if no holes 50, 60 or no non-joint areas 55 and 65 with the flexible substrate 1 exist). The rooms and the non-joint areas 55 and 65 are filled with the hot-melt adhesive 7.

Figure 14:
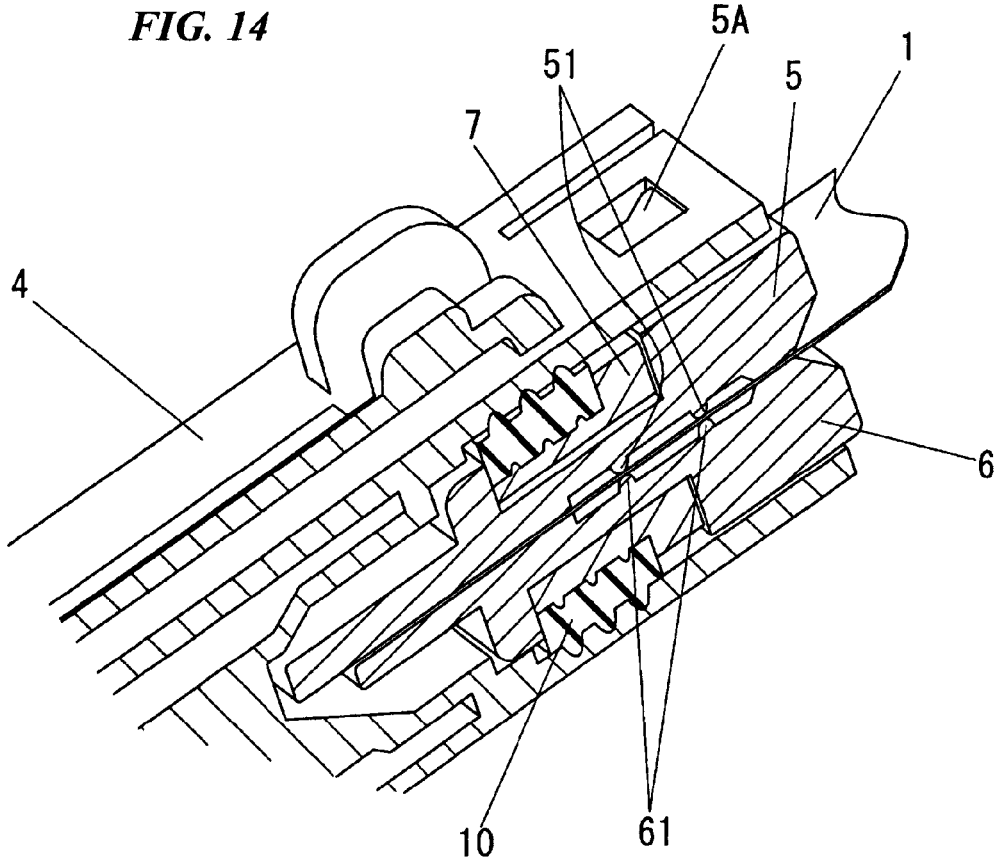
FIG. 14 is a cross-sectional perspective view showing the vicinity of the retainer according to the second embodiment.
Figure 15:
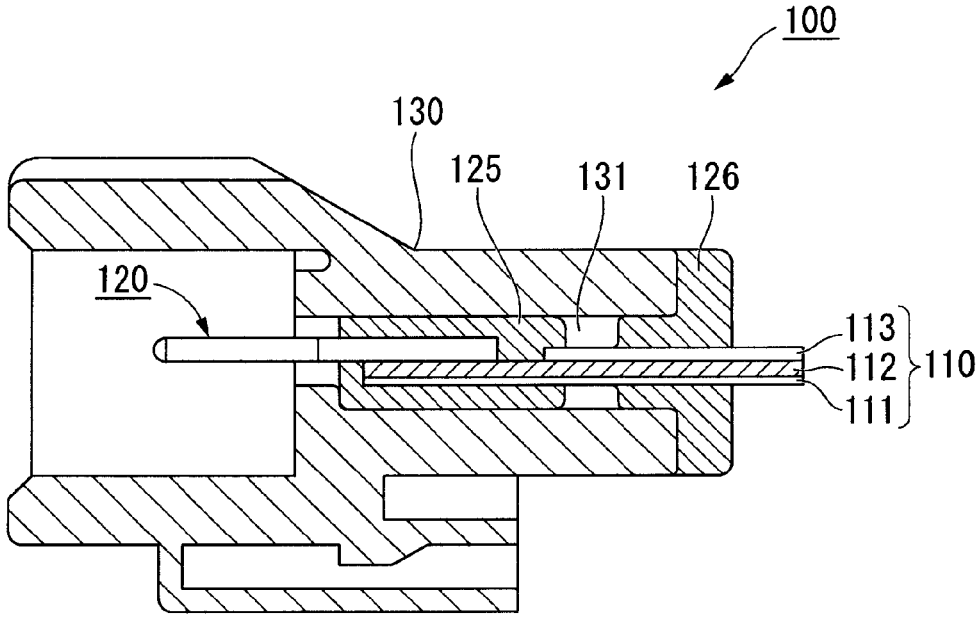
FIG. 15 is a cross-sectional view schematically showing a related art waterproof connector for a flexible substrate.

FIG. 14 is a cross-sectional perspective view through the small projections 51 and 61 in a state in which the flexible substrate 1 is firmly held by the retainers (i.e., the first member 5 and second member 6) via the hot-melt adhesive 7 and the sealing member 10 is provided to surround the cooled and cured hot-melt adhesive 7. As described above, the flexible substrate 1 is kept horizontal by the small projections 51 and 61.

In the first and second embodiments, the flexible substrate having the connection terminal 2, the retainer and the sealing member 10 provided thereon is fit into the male housing via the female housing. However, the flexible substrate 1 having the connection terminal 2, the retainer and the sealing member 10 provided thereon may alternatively be directly made to pass through or inserted in, for example, a vehicle door.

The waterproof connector for the flexible substrate according to the invention can be firmly sealed by the hot-melt adhesive while keeping the spring effect of the joint section of the terminal section of the flexible substrate and the connection terminal. In addition, the external force acting on the hot-melt adhesive is reduced so as to prevent deterioration in the adherence and waterproofness.

What is claimed is:

1. A waterproof connector for a flexible substrate, comprising:

a flexible substrate which includes an insulating film with a conductive pattern formed thereon;

a connection terminal joined to the conductive pattern at a terminal section of the flexible substrate;

a housing which accommodates the connection terminal;

a retainer which includes a vertically assembled pair of members, a forward end thereof holding the connecting section of the conductive pattern and the connection terminal and a rear end thereof surrounding the flexible substrate;

a hot-melt adhesive provided on an inner circumference of the retainer at non-joint areas with the flexible substrate and provided on an outer circumference of the retainer so as to make the flexible substrate and the retainer adhere closely to each other;

engaging member provided in the outer circumference of the retainer; and receiving member provided in the housing, wherein the engaging member and the receiving member are engaged together to fix the retainer and the housing.

2. The waterproof connector for a flexible substrate according to claim 1, wherein a plurality of small projections is provided on opposing surfaces at a rear end of the retainer.

3. The waterproof connector for a flexible substrate according to claim 1, wherein:

the connecting section has a spring effect; and the forward end of the retainer holds the connecting section so as not to impair the spring effect of the connecting section.

4. The waterproof connector for a flexible substrate according to claim 1, wherein the hot-melt adhesive is provided to surround the flexible substrate that is disposed within the rear end of the retainer without escaping from the rear end of the retainer.

5. The waterproof connector for a flexible substrate according to claim 1, further comprising a sealing member that surrounds an outer circumference of the hot-melt adhesive provided on the outer circumference of the retainer.

6. The waterproof connector for a flexible substrate according to claim 1, wherein:

the connection terminal is a female terminal;

the housing is a female housing; and the waterproof connector further includes a male housing that receives the female housing.

* * * * *